US006677716B2

(12) United States Patent
Rudolph et al.

(10) Patent No.: US 6,677,716 B2
(45) Date of Patent: Jan. 13, 2004

(54) OPERATING DEVICE FOR GAS DISCHARGE LAMP

(75) Inventors: Bernd Rudolph, Forstern (DE); Arwed Storm, Dachau (DE)

(73) Assignee: Patent Treuhand Gesellschaft fur Elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/323,748

(22) Filed: Dec. 20, 2002

(65) Prior Publication Data

US 2003/0122504 A1 Jul. 3, 2003

(30) Foreign Application Priority Data

Jan. 2, 2002 (DE) ..... 102 00 049

(51) Int. Cl.[7] ..... H05B 37/00

(52) U.S. Cl. ..... 315/224; 315/244; 315/283; 315/291; 315/307; 315/DIG. 7

(58) Field of Search ..... 315/224, 225, 315/243, 244, 276, 283, 291, 307, DIG. 2, DIG. 5, DIG. 7

(56) References Cited

U.S. PATENT DOCUMENTS

| | | | | |
|---|---|---|---|---|
| 4,525,648 A | | 6/1985 | De Bijl et al. | 315/224 |
| 5,619,106 A | * | 4/1997 | Secen | 315/290 |
| 5,737,207 A | * | 4/1998 | Uratani et al. | 363/132 |
| 5,864,212 A | * | 1/1999 | Sullivan | 315/205 |

FOREIGN PATENT DOCUMENTS

| | | |
|---|---|---|
| EP | 0 093 469 | 11/1983 |

* cited by examiner

*Primary Examiner*—Don Wong
*Assistant Examiner*—Thuy Vinh Tran

(57) ABSTRACT

Free-running half-bridge inverter (HP) for operating gas discharge lamps having a current transformer as a feedback device. The half-bridge transistors (T1, T2) are essentially voltage controlled transistors (MOSFET). The drive circuits (1, 2) for the half-bridge transistors (T1, T2) contain a voltage threshold value switch (D2, R2) which, on reaching its voltage threshold, essentially carries a current which is proportional to the load current of the half-bridge inverter (HB).

8 Claims, 3 Drawing Sheets

OPERATING DEVICE FOR GAS DISCHARGE LAMP

TECHNICAL FIELD

The invention relates to an operating device for gas discharge lamps as claimed in the precharacterizing clause of claim 1. This relates in particular to an improvement to the half-bridge inverter contained in the operating device, and to its drive. The invention furthermore relates to simplification of a switching-off device for the operating device, and to low-cost power factor correction for the current drawn from the mains.

BACKGROUND ART

The document EP 0 093 469 (De Bijl) describes an operating device for gas discharge lamps, which represents the prior art. This operating device contains a free-running half-bridge inverter, which uses a DC voltage to produce a high-frequency AC voltage by switching an upper and a lower half-bridge transistor, which are connected in series, on and off alternatively. The DC voltage is generally produced by means of a bridge rectifier, comprising four rectifier diodes, from the mains voltage. In this context, free-running means that the drive for the half-bridge transistors is obtained from a load circuit, and that no independently oscillating oscillator circuit is provided to produce said drive. Said drive is preferably obtained by means of a current transformer. A primary winding of the current transformer is arranged in the load circuit and a load current flows through it which is essentially equivalent to the load current, which can essentially be equated to the current which is emitted from the half-bridge inverter. One secondary winding of the current transformer is arranged in each of two drive circuits, which each produce a signal which is supplied to the control electrodes of the half-bridge transistors. The load circuit is connected to the connection point of the half-bridge transistor. The main component of the load circuit is a lamp inductor, to which gas discharge lamps can be connected in series, via terminal connections. It is also possible to connect a number of load circuits in parallel; the primary winding can then be arranged such that the total current from all the load circuits flows through it.

Each of the drive circuits produces a feedback signal, which is essentially proportional to the load current. Ideally, the secondary windings must be short-circuited for this purpose, but in practice they are terminated with a low impedance. Otherwise, either saturation phenomena would occur in the current transistor or the primary winding would have an undesirably strong influence on the load circuit. According to the prior art, bipolar transistors are used for the half-bridge transistors, drawing their drive from the secondary windings. The base connection of the bipolar transistors, which is used as a control electrode, naturally has a sufficiently low impedance to avoid the abovementioned effects.

The voltage drop across the secondary windings in the abovementioned conditions represents a measure of the load current and, in the prior art, forms feedback signals. These are in each case supplied to a timer which, in the simplest case, comprises a timing capacitor and a timing resistor connected in series. If the respective timing capacitor is charged to an integration value which is sufficient to drive a switching-off transistor, the respective half-bridge transistor is switched off.

A resonance capacitor, which together with the lamp inductor forms a resonance circuit, is effectively connected in parallel with a gas discharge lamp and in series with the lamp inductor, in particular in order to start gas discharge lamps. This resonance circuit is operated close to its resonance point for starting, thus resulting in a voltage which is sufficiently high to start a gas discharge lamp being formed across the resonant capacitor.

A high current is accordingly formed in the lamp inductor and thus in the half-bridge transistors. In order to avoid components being overloaded, the amplitude of the load current is limited in the prior art. This is done via in each case one first voltage threshold value switch, which is connected in parallel with the respective timing resistor. If the load current rises above a predetermined level, then the respective feedback signal reaches a value which can break through the respective first voltage threshold value switch, thus leading to the respective half-bridge transistor being switched off immediately.

DISCLOSURE OF THE INVENTION

The object of the present invention is to provide an operating device for gas discharge lamps as claimed in the precharacterizing clause of claim 1, which makes the topology described in the prior art feasible not only for half bridges with bipolar transistors, which require a drive current of course, but also allows voltage controlled semiconductor switches such as MOF field-effect transistors (MOSFET) to be used. The object on which this problem is based essentially includes the provision of a drive signal for the semiconductor switches which is proportional to the load current.

This object is achieved by an operating device for gas discharge lamps having the features of the precharacterizing clause of claim 1 and by means of the features of the characterizing part of claim 1. Particularly advantageous refinements can be found in the dependent claims.

Bipolar transistors are increasingly being replaced by voltage controlled semiconductor switches such as MOSFETs and IGBTs, mainly for cost reasons.

If one of the secondary windings described above is used to drive a voltage controlled semiconductor switch rather than a bipolar transistor, then the termination of the secondary winding no longer has a low impedance but a high impedance, and the disadvantages mentioned in the section relating to the prior art occur. According to the invention, the drive circuits are each equipped with a second voltage threshold value switch, which has a second voltage threshold and is connected in parallel with the secondary winding. In the simplest case, the second voltage threshold value switch comprises a zener diode and a current measurement resistor connected in series, with the zener diode having a zener voltage which corresponds to the second voltage threshold. If the voltage across the secondary winding rises, starting from zero, then the second voltage threshold value switch initially has no effect. On reaching the second voltage threshold, the zener diode starts to conduct, and the secondary winding is terminated with a low impedance, as desired. The value of the second voltage threshold must be lower than a threshold voltage which the voltage controlled semiconductor switch requires, as a minimum, as a drive. The size of the current measurement resistor has to satisfy two conditions. Firstly, the value of the current measurement resistor must be small enough to ensure a low-impedance termination on the secondary winding. Secondly, the value of the current measurement resistor must be high enough to allow the voltage across the secondary winding to rise further as far as the first voltage threshold.

Since a current which is essentially proportional to the load current flows in the current measurement resistor according to the invention, the voltage across the current measurement resistor is, of course, also a measure of the load current. The voltage across the current measurement resistor may thus be used, according to the invention, in order to detect a fault situation. For this purpose, it is supplied to a switching-off device. In order to suppress interference, the time average of the voltage across the current measurement resistor is formed in the switching-off device. If this exceeds a given limit value, the switching-off device prevents further oscillation of the half-bridge inverter. This is done in particular by suppressing the drive signal for one of the two half-bridge transistors.

The operating devices under discussion generally have two mains voltage terminals which can be connected to a mains voltage, thus allowing a mains current to flow. Relevant standards (for example: IEC 1000-3-2) specify maximum amplitudes for the harmonics in the mains current. In order to comply with these Standards, operating devices have so-called PFC circuits (Power Factor Correction). One low-cost implementation for these PFC circuits is represented by so-called pumping circuits, as are described, for example, in EP 253 224 (Zuchtriegel) or EP 1 028 606 (Rudolph). If a pumping circuit is combined with a free-running half-bridge inverter according to the prior art, this leads to problems in producing the necessary starting voltage for the gas discharge lamps, and problems due to the high power losses during switching of the half-bridge transistors. Said problems occur in particular in the case of high-power gas discharge lamps. One reason for this, inter alia, is the storage times, which are typical for bipolar transistors and do not allow the switching-off time to be defined exactly. The present invention allows the use of voltage controlled semiconductor switches such as MOSFETs, which have no storage times and therefore allow said problems to be avoided. This means that the half-bridge inverter according to the invention in conjunction with a pumping circuit can be used advantageously even for a load which consumes a power of more than 100 W.

A further effect which occurs in the case of the half-bridge inverter according to the invention with a pumping circuit is the heavy modulation of the operating frequency by the mains voltage, which is subject to the oscillation of the half-bridge inverter. Depending on the instantaneous value of the mains voltage, said operating frequency is within a frequency band which has a bandwidth of more than 10 kHz. The electromagnetic interference caused by an operating device according to the invention is thus distributed over a wide frequency band. The amount of energy reaching an appliance that is subject to interference is thus advantageously low. Furthermore, the complexity for suppression of an operating device according to the invention can be kept low.

A further advantageous application of the current measurement resistor according to the invention is in the starting circuit for the free-running half-bridge inverter. In order to start the half-bridge inverter, the normal process is to charge a starting capacitor and, when a trigger voltage is reached across the charge-storage capacitor, to discharge a portion of the charge stored in the charge-storage capacitor via a trigger element to the control electrode of a half-bridge capacitor. In this case, one problem that can occur is that the charge pulse produced in this way at the relevant control electrode is too short and too small, and continued oscillation of the half-bridge inverter is not triggered. According to the invention, a portion of the stored charge in the charging capacitor is supplied via a diode to the current measurement resistor according to the invention. This makes it possible to ensure that the half-bridge inverter starts to oscillate reliably.

BRIEF DESCRIPTION OF THE DRAWINGS

The invention will be explained in more detail in the following text with reference to exemplary embodiments.

In the figures.

In the following text, resistors are denoted by the letter R, transistors by the letter T, diodes by the letter D, capacitors by the letter C and connecting terminals by the letter J, in each case followed by a number.

BEST MODE FOR CARRYING OUT THE INVENTION

Figure 1:
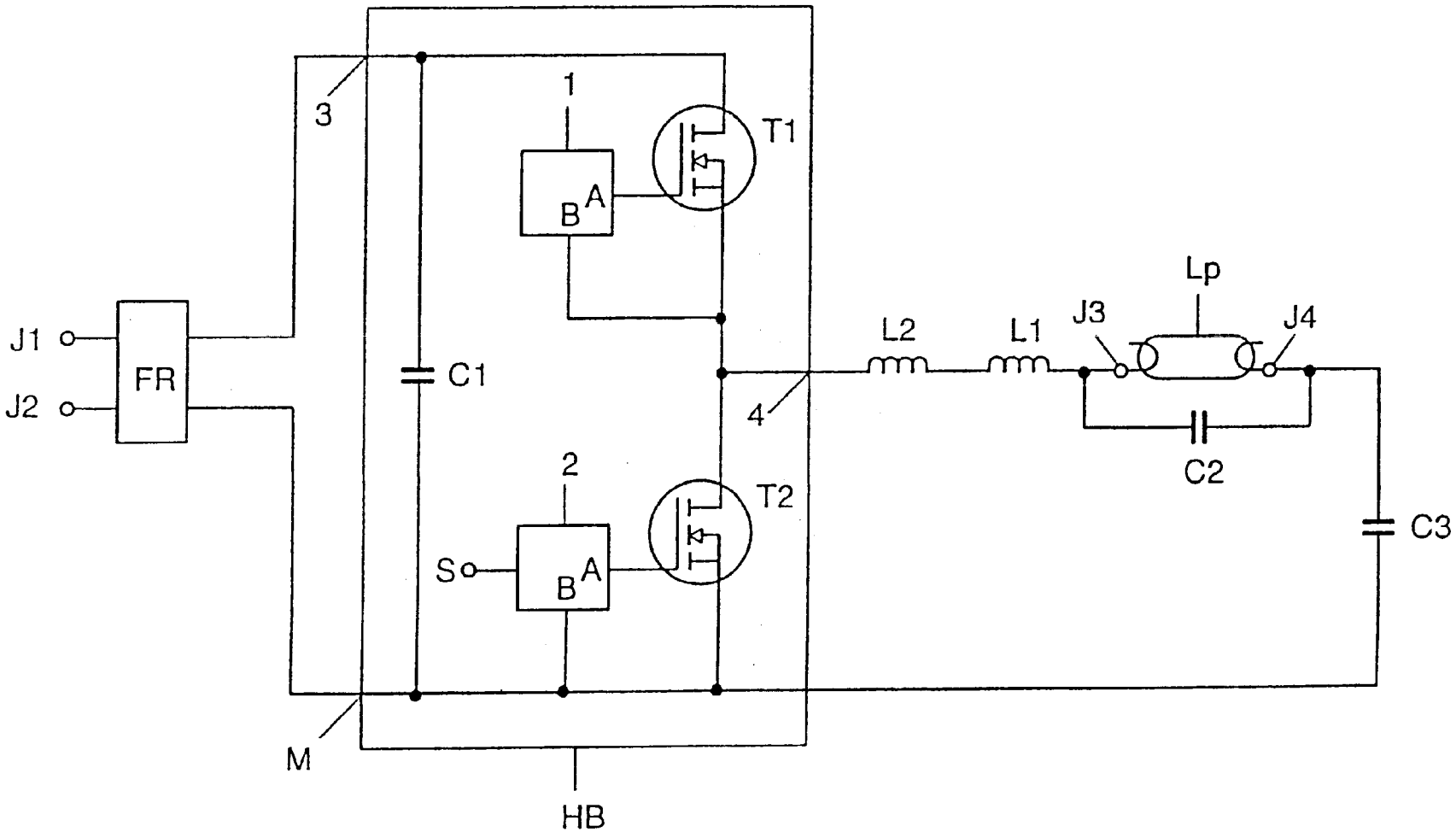
FIG. 1 shows the basic circuit of the operating device according to the invention.

FIG. 1 shows the basic circuit of an operating device according to the invention. The operating device can be connected to a mains voltage via the connecting terminals J1, J2. The mains voltage is supplied to a block FR, which contains generally known filter and rectifier devices. The filter devices have the task of suppressing interference. The rectifier device generally comprises a bridge rectifier having four diodes. The rectifier device is used to supply a DC voltage to a half-bridge inverter HB. The half-bridge inverter essentially contains an upper semiconductor switch T1 and a lower semiconductor switch T2, which are connected in series and, according to the invention, are voltage-controlled. The exemplary embodiment in FIG. 1 uses N-channel MOSFETs. However, it is also possible to use, for example, IGBTs or P-channel MOSFETs. With the N-channel MOSFET used in FIG. 1, the positive output of the rectifier device must be supplied via a node 3 to the upper transistor T1, while the negative output of the rectifier device is connected to the ground potential M. The same polarity is used for commercially available IGBTs, but the opposite polarity must be used for P-channel MOSFETs.

An energy-storage capacitor C1 is connected between the node 3 and the ground potential M and temporarily stores energy from the mains voltage, before it is emitted to a lamp LP.

In order to drive the half-bridge transistors T1, T2, the half-bridge inverter HB contains a drive circuit 1, 2 for each half-bridge transistor T1, T2. The drive circuits 1, 2 are each connected via a connection A to the respective gate connection and via a connection B to the respective source connection, of the relevant half-bridge transistor. The drive circuit 2 for the lower half-bridge transistor T2 has a third connection S, to which a switching-off device can be connected.

The connection point of the half-bridge transistors T1, T2 forms a node 4, to which a load circuit is connected. A second connection of the load circuit in FIG. 1 is connected to the ground potential M. In an equivalent manner, the second connection of the load circuit may alternatively be connected to the node 3. The load circuit essentially comprises a series circuit formed by a primary winding L2 of a current transformer, a lamp inductor L1, a resonance capacitor C2 and a coupling capacitor C3. One or more series-connected lamps LP can be connected via the lamp terminals J3, J4 in parallel with the resonance capacitor C2. In the exemplary embodiment, no provision is made for preheating the lamp filaments. However, generally known devices for filament heating are available to those skilled in the art, and can be used with the operating device according to the invention. It is also possible to operate a number of load circuits connected in parallel. The function of the individual elements of the load circuit can be found in the prior art.

Figure 2:
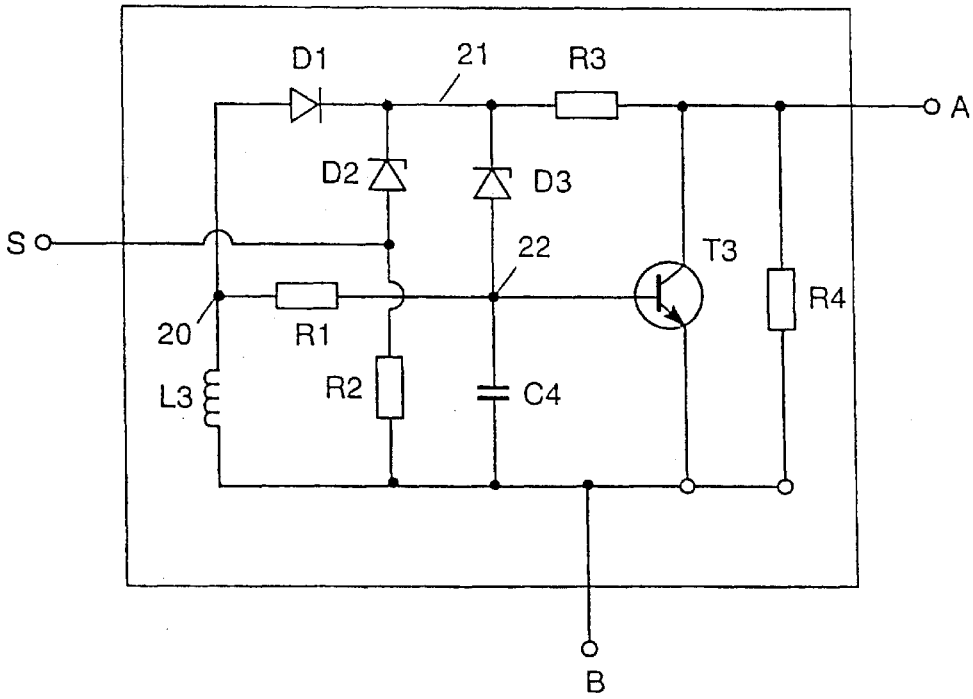
FIG. 2 shows an exemplary embodiment of a drive circuit according to the invention.

FIG. 2 shows one preferred exemplary embodiment of a drive circuit according to the invention. A secondary winding L3 of the current transformer is connected between a node 20 and the connection B, which is known from FIG. 1. The anode of a diode D1 is connected to the node 20, and its cathode is connected to a node 21. The node 21 is connected via a resistor R3 to the connection A, which is known from FIG. 1. An integration element is connected in parallel with the secondary winding L3 and is in the form of a timing resistor R1 and a timing capacitor C4 connected in series, and has an integration constant which corresponds to the product of the values of R1 and C4. The connection point of R1 and C4 forms a node 22. An integration value is tapped off in parallel with C4, and is supplied to the control electrode of a semiconductor switch T3. The switching path of the semiconductor switch T3 is connected between the connections A and B. As in the exemplary embodiment, a resistor R4 may be connected in parallel with this, in order to improve the switching reliability. The semiconductor switch T3 is preferably in the form of a small signal bipolar transistor.

A first voltage threshold value switch with a first voltage threshold is connected between the node 21 and the node 22, and is in the form of a zener diode D3. If the voltage which is fed into the drive circuit from L3 exceeds a value which leads to the zener voltage of D3 being exceeded, then the timing capacitor C4 is charged not only via the timing resistor R1 but also via D3, so that the integration constant of the integration element is reduced.

According to the invention, a second voltage threshold value switch with a second voltage threshold is connected between the node 21 and the connection B. This is preferably formed by a zener diode D2 and a current measurement resistor R2 connected in series. If the voltage at L3 rises, the associated half-bridge transistor is first of all driven via the connection A. After the voltage at R2 rises further, the zener voltage of D2 is, according to the invention, exceeded. A current flow therefore occurs via the current measurement resistor R2, which is essentially proportional to the load current in the load circuit. This prevents the current transformer from being saturated, and the integration element is charged in proportion to the load current. If the current in the load circuit becomes so great that the zener voltage of D3 is exceeded, then this leads to the associated half-bridge transistor being switched off quickly.

One connection S is connected to the connection point between D2 and the current measurement resistor R2. A voltage which is proportional to the load current can be tapped off between the connection S and the connection B and can be supplied to a switching-off device, as described below. Since the voltages in the switching-off device are in general related to the ground potential M, only the drive circuit associated with the lower half-bridge transistor has a connection S.

The following table summarizes the preferred sizes of the components illustrated in FIG. 2.

| Component | Value |
|---|---|
| D2 | 5.6 V |
| D3 | 22 V |
| R1 | 1.8 kΩ |
| R2 | 27 Ω |
| R3 | 220 Ω |
| R4 | 2.2 kΩ |
| C4 | 10 nF |

Figure 3:
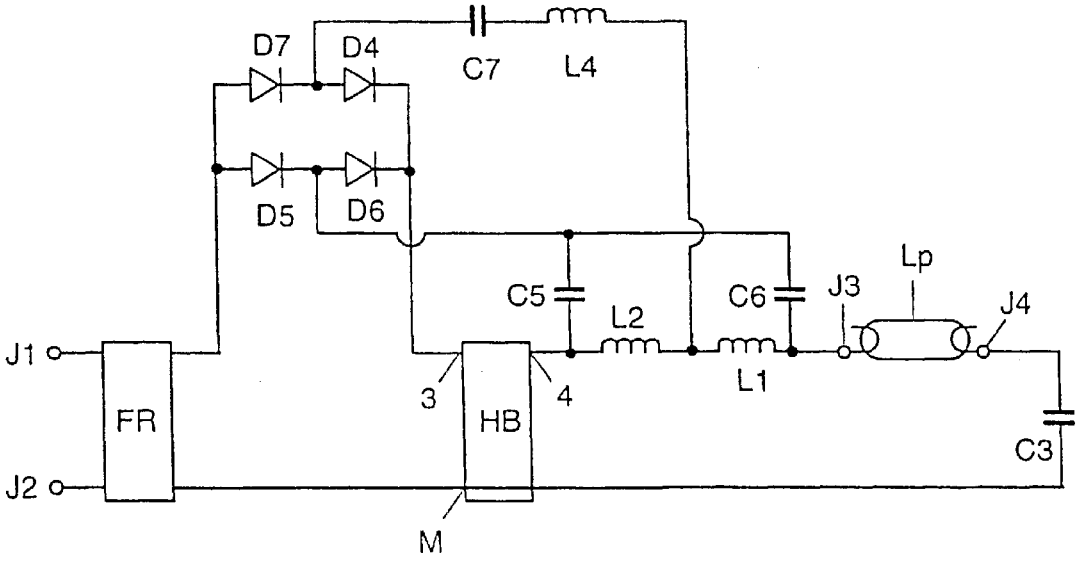
FIG. 3 shows an exemplary embodiment of an operating device according to the invention having a pumping circuit.

In FIG. 3, the half-bridge converter HB according to the invention is provided in an operating device with a pumping circuit, as is described in FIGS. 1 and 2. In contrast to FIG. 1, the positive output of the rectifier device in the block FR is not connected directly to the node 3, but via two parallel-connected series circuits, each having two diodes. A first diode series circuit with a first diode connection point is formed by the diodes D5 and D6. A second diode series circuit with a second diode connection point is formed by the diodes D4 and D7. Different nodes of the load circuit which is known from FIG. 1 are connected to the diode connection points via reactive two-pole networks.

The lamp terminal J3 is connected to the first diode connection point via a pumping capacitor C6. The lamp terminal J3 is distinguished from the lamp terminal J4 in that the value of the amplitude of its AC voltage component with respect to the ground potential is higher. The resonance capacitor C2 from FIG. 1 is omitted. Its function is carried out by the pumping capacitor C6.

The connection point of the primary winding L2 and of the lamp inductor L1 is connected to the second diode connection point via a pumping inductor L4 and a capacitor C7 connected in series. However, the pumping inductor L4 may also be connected directly to the node 4, which is known from FIG. 1 and represents the connection point of the half-bridge transistors T1 and T2. The capacitor C7 is essentially used for blocking any DC component in the current through the pumping inductor L4.

The node 4, which is known from FIG. 1, is connected to the first diode connection point via a second pumping capacitor C5.

FIG. 3 shows a pumping circuit structure having three so-called pumping branches: one pumping branch is represented by the pumping capacitor C6, a further by the second pumping capacitor C5, and a third by the pumping inductor L4. Each pumping branch intrinsically already acts as a PFC circuit, so that it is not always necessary for all three pumping branches to be provided. In fact, any desired combination of the pumping branches is possible.

A further variation option relates to the diodes D5 and D7. These diodes may also carry out functions which are associated with the rectifier device in the block FR. Corresponding diodes in the rectifier device can then be omitted.

Figure 4:
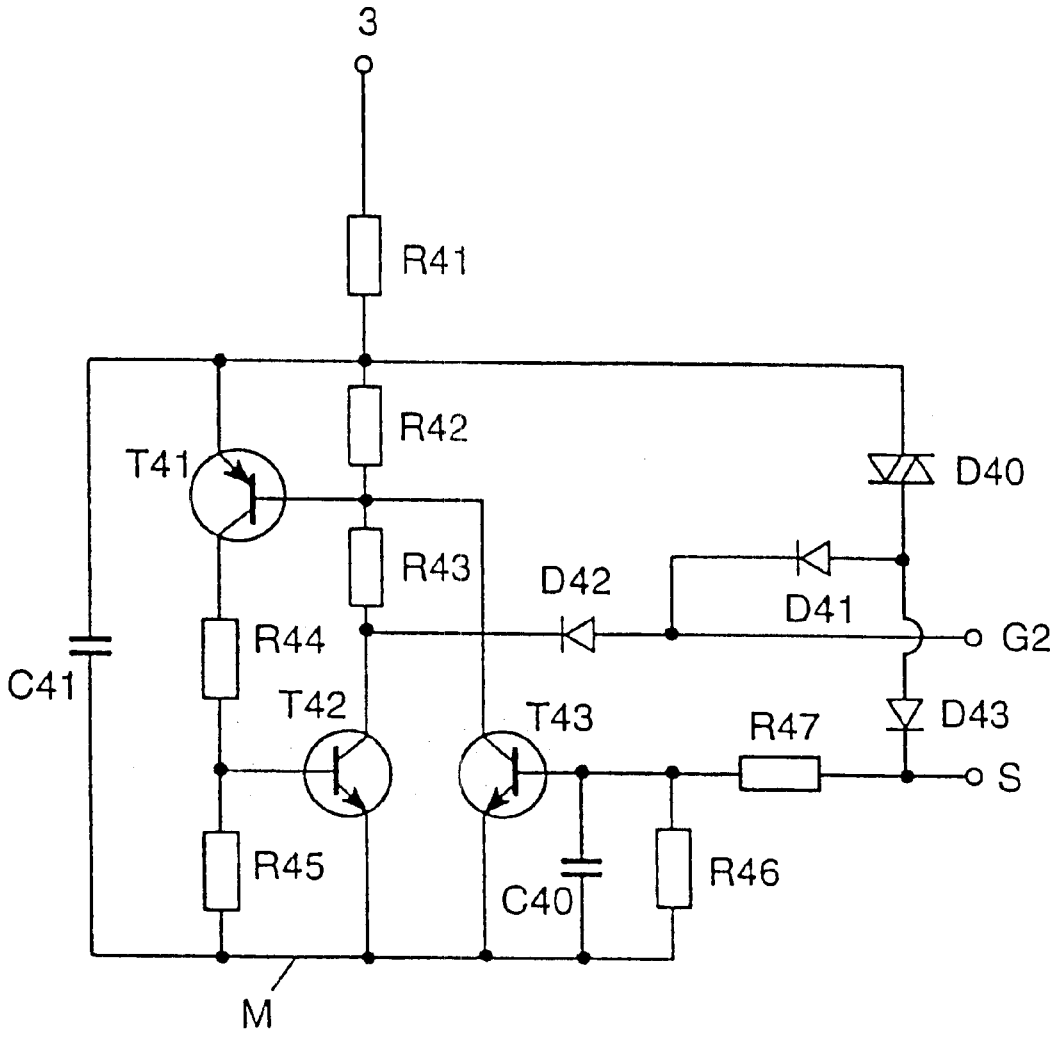
FIG. 4 shows an exemplary embodiment of a switching-off device according to the invention.

FIG. 4 shows how the current measurement resistor R2 according to the invention and the connection S connected to it from FIG. 2 can advantageously be used for a switching-off device and a starting device for the operating device.

The switching-off device contains a generally known thyristor simulation comprising the resistors R42, R43, R44 and R45 and the transistors T41 and T42. The thyristor simulation is connected to the node 3 from FIG. 1 via a resistor R41. The other end of the thyristor simulation is connected to ground potential M.

A voltage which is proportional to the load current is fed via the connection S into a voltage divider comprising the resistors R46 and R47. The voltage divider divides the voltage that is fed in to a value which normally does not cause the operating device to be switched off. The time average of the load current is formed by a capacitor C40, which is fed from the voltage divider, and is provided in the form of a voltage related to ground potential. This voltage is supplied to the control electrode of a semiconductor switch, which is in the form of a bipolar transistor T43. If the mean value of the load current exceeds a predetermined level in the event of a fault, then the thyristor simulation is triggered via the collector connection of T43. A connection G2, which is connected to the control electrode of the lower half-bridge transistor, is in consequence connected via a diode D42 to ground potential M. This prevents further oscillation of the half-bridge inverter.

The half-bridge inverter starts to oscillate with the aid of a generally known starting capacitor C41, which is charged from the mains voltage via the resistor R41. C41 is connected to a trigger diode D40 (DIAC). When the voltage on C41 reaches the trigger voltage of the trigger diode D40, the control electrode of the lower half-bridge transistor has a starting pulse applied to it via a diode D41 and the connection G2. In practice, the starting pulse may turn out to be short so that the half-bridge inverter does not reliably start to oscillate. The connection S is therefore advantageously used: according to the invention, the connection S is connected to the trigger diode D40 via a diode D43. The starting pulse passes not only via the diode D41 but, according to the invention, also via the diode D43 and then via the diode D2 and the resistor R3 from FIG. 2. The starting pulse is thus lengthened and enlarged, thus leading to the half-bridge inverter starting to oscillate reliably.

What is claimed is:

1. An operating device for operating gas discharge lamps, having the following features:

a free-running half-bridge inverter (HB) which contains two half-bridge transistors (T1,T2) connected in series, a load circuit which is connected to the connection point between the half-bridge transistors (4) and which contains a primary winding (L2) of a current transformer through which a load current flows which is drawn from the half-bridge inverter (HB), in each case one drive circuit (1, 2) for each half-bridge transistor (T1, T2), which in each case contains the following components:

a secondary winding (L3) of the current transformer, an integration element (R1, C4) which essentially integrates the voltage across the secondary winding (L3) of the current transformer and switches off the relevant half-bridge transistor on reaching a predetermined integration value, a first voltage threshold value switch (D3), which reduces an integration constant of the integration element on reaching a given first voltage threshold, characterized in that the half-bridge transistors (T1, T2) are essentially voltage controlled transistors, and at least one drive circuit (1, 2) has a second voltage threshold value switch (D2, R2) with a second voltage threshold which is lower than the first voltage threshold, with the second voltage threshold value switch (D2, R2) being connected in parallel with the secondary winding (L3).

2. The operating device as claimed in claim 1, characterized in that the second voltage threshold value switch contains a zener diode (D2) and a current measurement resistor (R2) connected in series.

3. The operating device as claimed in claim 2, characterized in that the voltage across the current measurement resistor (R2) is supplied to a switching-off device, which evaluates a time mean value or an instantaneous value of this voltage and, if a given limit value is exceeded, prevents further oscillation of the half-bridge inverter (HB).

4. The operating device as claimed in claim 2, characterized in that the operating device contains a starting capacitor (C41), which is connected to the current measurement resistor (R2) via a trigger diode (D40) and a diode (D43) connected in series.

5. The operating device as claimed in claim 1, characterized in that the operating device has two mains voltage terminals (J1, J2), which can be connected to a mains voltage, and power factor correction for a mains current flowing via the mains voltage terminals (J1, J2) is achieved by means of a pumping circuit.

6. The operating device as claimed in claim 5, characterized in that the pumping circuit has the following features:

a portion of the mains current flows via a first pumping diode (D5) which, with a second pumping diode (D6), forms a first diode series circuit having a first diode connection point, with the diodes being connected such that they allow current to flow from the mains terminals to the half-bridge inverter (HB), the operating device has at least two lamp terminals (J3, J4), which can be connected to lamp connections, with one lamp terminal (J3) being connected to the first diode connection point via a pumping capacitor (C6).

7. The operating device as claimed in claim 6, characterized in that the pumping capacitor (C6) is connected to that lamp terminal (J3) which, with respect to a reference ground potential (M), is at a voltage which has a maximum value for an AC voltage component in comparison to the voltage at the other lamp terminals (J4).

8. The operating device as claimed in claim 6, characterized by the following features:

a second diode series circuit formed by two diodes (D4, D7) is connected in parallel with the first diode series circuit, thus forming a second diode connection point, with the diodes (D4, D7) being connected such that they allow current to flow from the mains to the half-bridge inverter (HB), the second diode connection point is connected at least via a pumping inductor (L4) to the connection point (4) of the half-bridge transistors (T1, T2).

* * * * *